US012252940B2

(12) United States Patent
Feddema

(10) Patent No.: US 12,252,940 B2
(45) Date of Patent: Mar. 18, 2025

(54) MWD ISOLATION DEVICE

(71) Applicant: TURBO DRILL INDUSTRIES, INC., Conroe, TX (US)

(72) Inventor: Chad Feddema, Conroe, TX (US)

(73) Assignee: TURBO DRILL INDUSTRIES, INC., Conroe, TX (US)

( * ) Notice: Subject to any disclaimer, the term of this patent is extended or adjusted under 35 U.S.C. 154(b) by 0 days.

(21) Appl. No.: 18/755,958

(22) Filed: Jun. 27, 2024

(65) Prior Publication Data

US 2025/0003297 A1 Jan. 2, 2025

Related U.S. Application Data

(60) Provisional application No. 63/524,155, filed on Jun. 29, 2023.

(51) Int. Cl.
*E21B 17/07* (2006.01)

(52) U.S. Cl.
CPC ..... *E21B 17/07* (2013.01)

(58) Field of Classification Search
CPC ..... E21B 17/07; E21B 17/073; E21B 17/076; F16C 3/035; F16D 3/065
USPC ..... 464/18, 19, 20, 21, 169; 175/321, 322
See application file for complete search history.

(56) References Cited

U.S. PATENT DOCUMENTS 1,662,358 A * 3/1928 Bozeman ..... E21B 17/07 175/321
2,334,309 A * 11/1943 Brown ..... E21B 17/07 464/18
3,257,827 A 6/1966 Hughes
3,274,798 A * 9/1966 Wiggins, Jr. ..... E21B 17/07 175/320
3,306,078 A 2/1967 Hughes
(Continued)

FOREIGN PATENT DOCUMENTS

DE 1801229 A1 * 4/1969 ..... E21B 17/07
DE 102016102863 A1 * 8/2017 ..... F16D 3/065
(Continued)

OTHER PUBLICATIONS

International Search Report and Written Opinion issued in PCT App. No. PCT/US2024/035730, dated Oct. 16, 2024 (10 pages).

*Primary Examiner* — Josh Skroupa
(74) *Attorney, Agent, or Firm* — EWING & JONES, PLLC

(57) ABSTRACT

An isolator for use with a drill string comprises a low frequency portion and a high frequency portion coupled thereto. The low frequency portion comprises a low frequency mandrel and a low frequency housing that defines a chamber in conjunction therewith. The chamber may include a low frequency damping element disposed therein. The low frequency mandrel may be slidably received in the low frequency housing. The high frequency portion includes a high frequency housing including at least one longitudinal keyway, a high frequency mandrel having first and second ends and including at least one radially extending longitudinal key disposed in the at least one keyway; and at least one longitudinal damping element disposed in a keyway alongside the at least one key. The first anti-extrusion ring and the longitudinal damping element may be longitudinally compressed between the high frequency mandrel and a nut adjustably coupled to the high frequency mandrel.

18 Claims, 6 Drawing Sheets

(56) References Cited

U.S. PATENT DOCUMENTS 3,323,326 A 6/1967 Vertson
3,714,831 A 2/1973 Quichaud et al.
3,933,012 A * 1/1976 Ketchum ..... E21B 17/07 464/20
3,963,228 A * 6/1976 Karle ..... E21B 17/07 175/321
4,109,488 A 8/1978 Work
4,139,994 A * 2/1979 Alther ..... E21B 17/07 175/321
4,186,569 A * 2/1980 Aumann ..... F16D 3/06 175/321
4,194,582 A * 3/1980 Ostertag ..... E21B 17/07 175/321
4,232,751 A * 11/1980 Trzeciak ..... E21B 17/07 175/107
4,281,726 A * 8/1981 Garrett ..... E21B 17/07 175/321
4,571,215 A 2/1986 Hansen
4,844,181 A * 7/1989 Bassinger ..... E21B 17/07 175/321
5,224,898 A * 7/1993 Johnson ..... E21B 17/073 464/20
5,520,246 A 5/1996 Van Steenwyk et al.
5,964,307 A * 10/1999 Wenzel ..... E21B 17/07 175/321
6,808,455 B1 * 10/2004 Solorenko ..... F16D 3/12 464/20
9,157,284 B2 * 10/2015 Barnes ..... E21B 17/076
9,476,261 B2 10/2016 Venugopal et al.
10,533,376 B2 * 1/2020 Reimers ..... E21B 17/073
10,982,492 B1 * 4/2021 Gopalan ..... E21B 17/07
11,708,734 B2 * 7/2023 McGarian ..... E21B 17/07 166/382
11,905,820 B2 * 2/2024 Volgmann ..... E21B 17/07
2017/0305454 A1 * 10/2017 Park ..... F16C 3/035
2020/0018377 A1 1/2020 Hohl et al.
2021/0079738 A1 3/2021 Peters et al.
2021/0087890 A1 3/2021 Dinica et al.
2022/0195815 A1 6/2022 Leicht et al.
2023/0124872 A1 * 4/2023 Von Gynz-Rekowski ..... E21B 17/07 175/61
2023/0151706 A1 5/2023 Ritchie et al.

FOREIGN PATENT DOCUMENTS

FR 2063801 A5 * 7/1971 ..... E21B 17/076
FR 2258515 A1 * 8/1975 ..... E21B 17/07
NO 343669 B1 5/2019
WO 2022250674 A1 12/2022

* cited by examiner

MWD ISOLATION DEVICE

CROSS-REFERENCE TO RELATED APPLICATIONS

This application is a nonprovisional application which claims priority from U.S. provisional application No. 63/524,155, filed Jun. 29, 2023, which is incorporated by reference herein in its entirety.

TECHNICAL FIELD/FIELD OF THE DISCLOSURE

The present disclosure relates generally to downhole tools, and specifically a device for mitigating the transmission of vibration along the drillstring.

BACKGROUND OF THE DISCLOSURE

Various types of drill strings are deployed in a borehole for exploration and production of hydrocarbons. A drill string generally includes drill pipe and a bottomhole assembly (BHA). While deployed in the borehole, the drill string may be subject to a variety of forces or loads. For example, the BHA or other components can experience torque, impact, and vibration in various combinations and of varying magnitudes and frequencies.

Drilling often involves using measurement while drilling (MWD) or logging while drilling (LWD) equipment, hereinafter used interchangeably. It is typically desirable to protect such equipment from the torsional, axial, and lateral vibrations and impacts that are a standard feature of drilling.

SUMMARY

According to some embodiments, an isolator for use with a drill string may comprise a low frequency portion and a high frequency portion. The low frequency portion may comprise a low frequency mandrel having first and second ends, and a low frequency housing, the housing defining a chamber in conjunction with the low frequency mandrel. The chamber may be fluid-filled and may include a low frequency damping element disposed therein. The low frequency damping element may comprise a Belleville spring stack. The low frequency mandrel may be slidably received in the chamber.

The high frequency portion may be coupled to the low frequency portion and may comprise: a high frequency housing including at least one longitudinal keyway; a high frequency mandrel coupled to the upper housing of the low frequency portion. The high frequency mandrel may have upper and lower ends and may include at least one radially extending longitudinal key disposed in the at least one keyway. At least one longitudinal damping element may be disposed in a keyway alongside the at least one key.

The low frequency housing may include a lower housing. The low frequency portion further may include a base having a base wall, a central bore therethrough, and a lower base portion. The base wall may be disposed in an annulus between the low frequency mandrel and the lower housing. The central bore may be sized to slidably receive the low frequency mandrel. The base wall may include at least one hole therethrough. The low frequency mandrel may have a first outer surface that may include at least one helical slot therein. The helical slot may cooperate with the lower housing to support a ball bearing in the hole such that axial and rotational movement of the low frequency mandrel relative to the lower housing are linked.

The high frequency portion of a tool according to some embodiments may further include a radial high frequency shoulder and at least a first anti-extrusion ring disposed between the high frequency shoulder and the at least one longitudinal damping element. The high frequency shoulder may be part of the high frequency mandrel. The high frequency portion may further include a nut adjustably coupled to the high frequency mandrel. The first anti-extrusion ring and the at least one longitudinal damping element may be longitudinally compressed between the high frequency shoulder and the nut. A second anti-extrusion ring may be disposed between the at least one longitudinal damping element and the nut.

The high frequency mandrel may be retained in the high frequency housing by frictional engagement of at least one of the longitudinal damping element and/or the anti-extrusion ring with the high frequency mandrel and the high frequency housing. The high frequency portion may further include a coupler between the nut and the at least one longitudinal damping element.

BRIEF DESCRIPTION OF THE DRAWINGS

The present disclosure may be best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
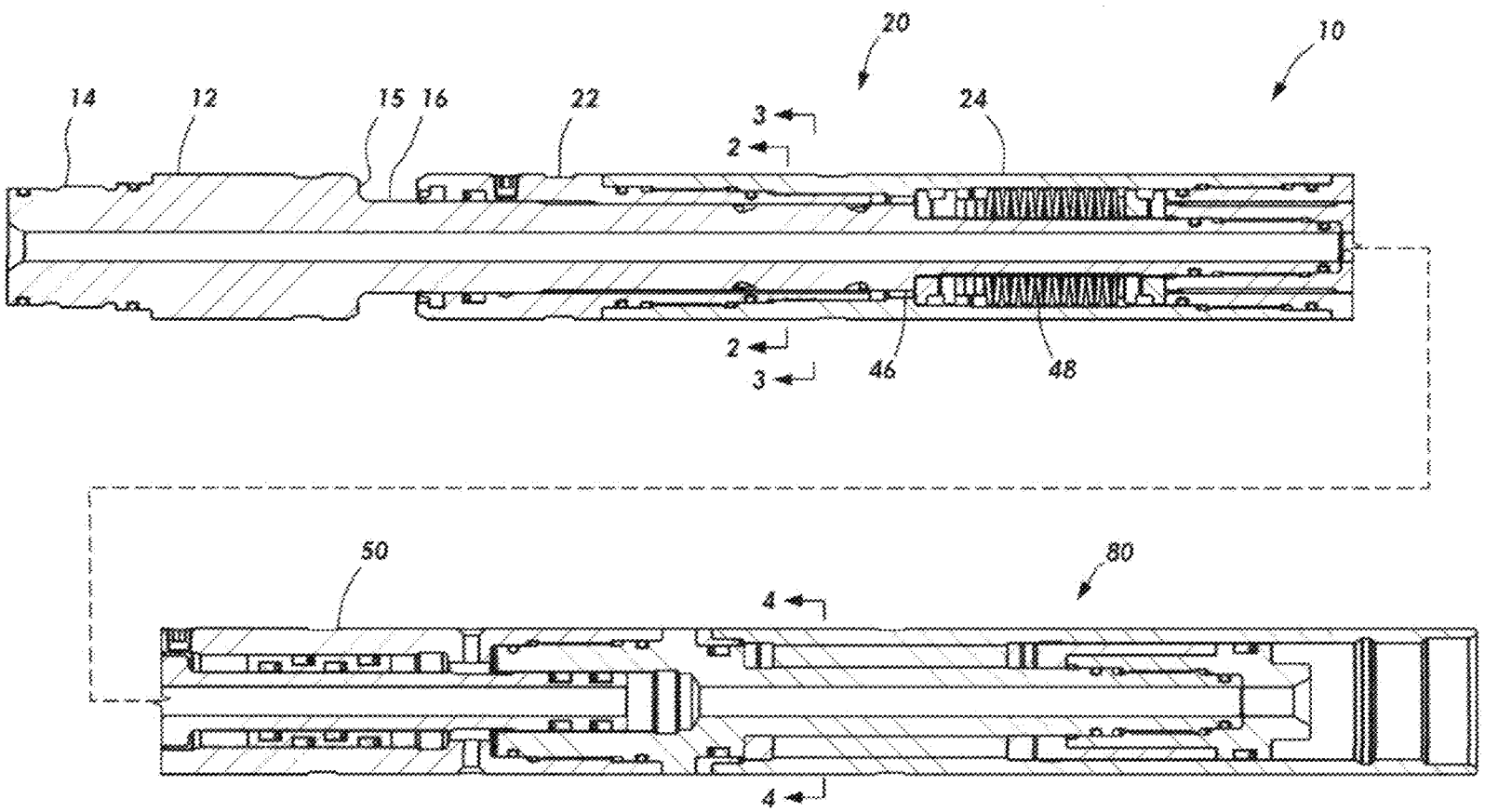
FIG. 1 is a longitudinal cross-section of a tool constructed according to an embodiment of the present disclosure.

It will be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Referring initially to FIG. 1, a downhole vibration damping tool 10 may include a low frequency portion 20 and a high frequency portion 80. Tool 10 may be configured to be included as part of a drill string (not shown) and the upper and lower ends of tool 10 may include threaded connections adapted for that purpose.

Figure 5A:
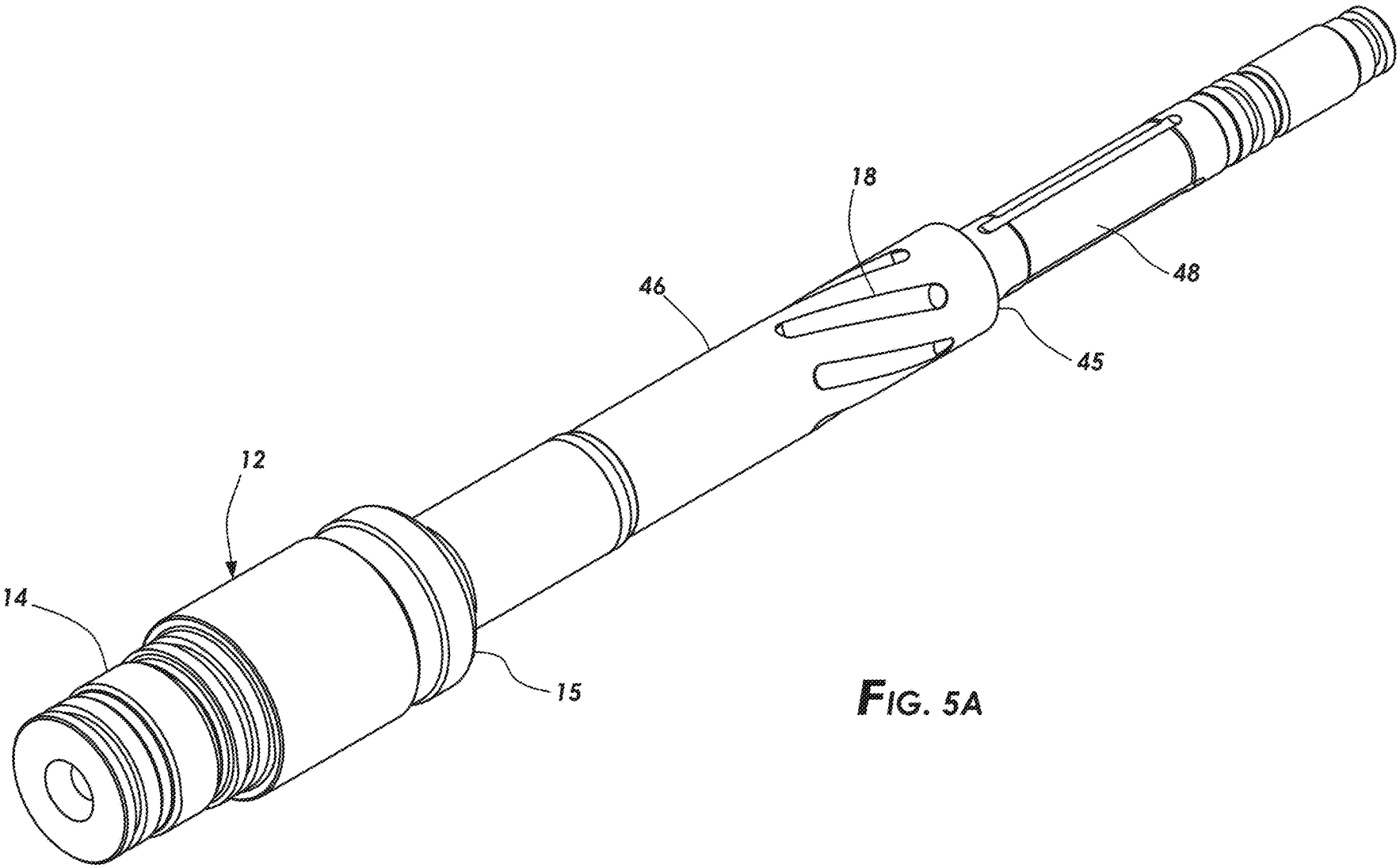
FIGS. 5A and 5B are a partially exploded view of a portion of the tool of FIG. 1.
Figure 5B:
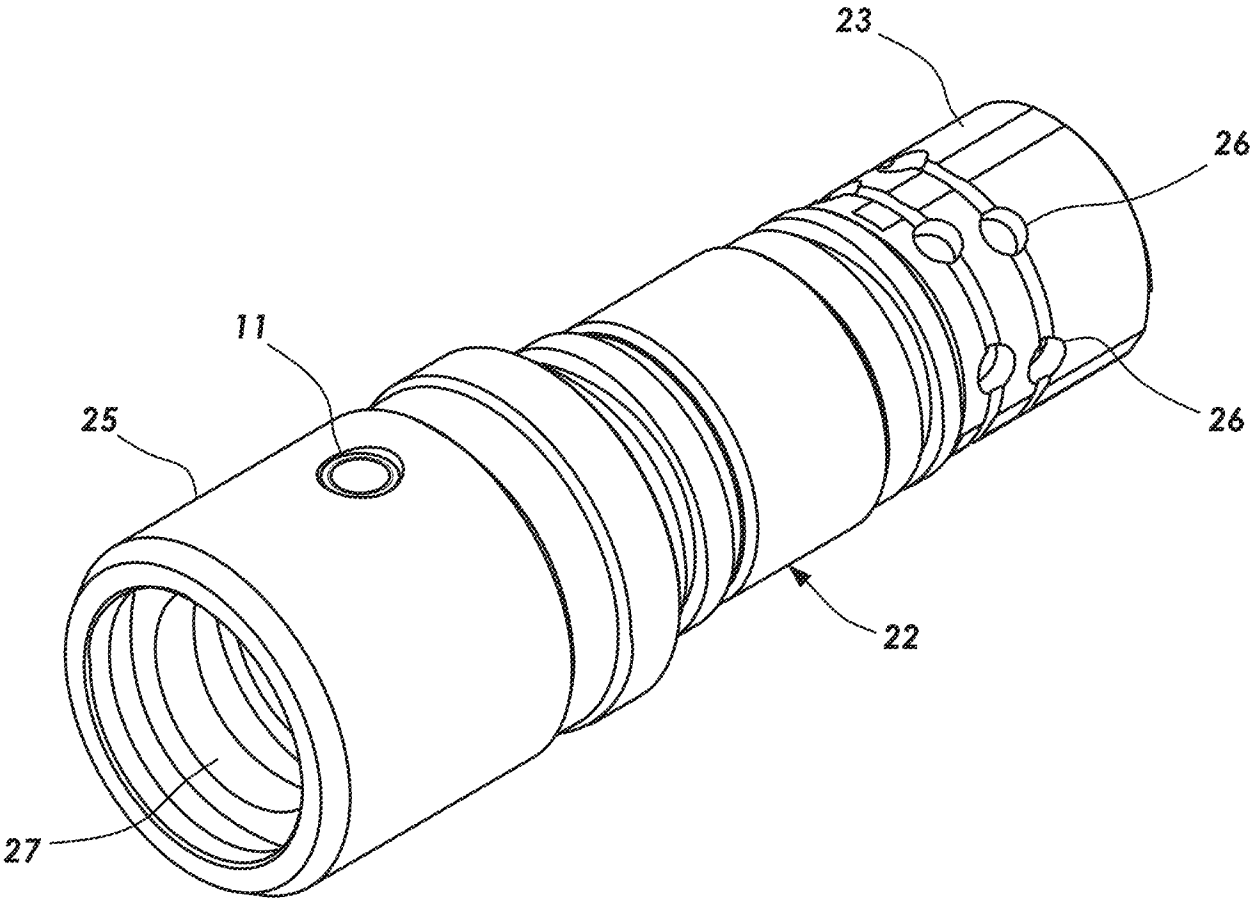
Figure 6A:
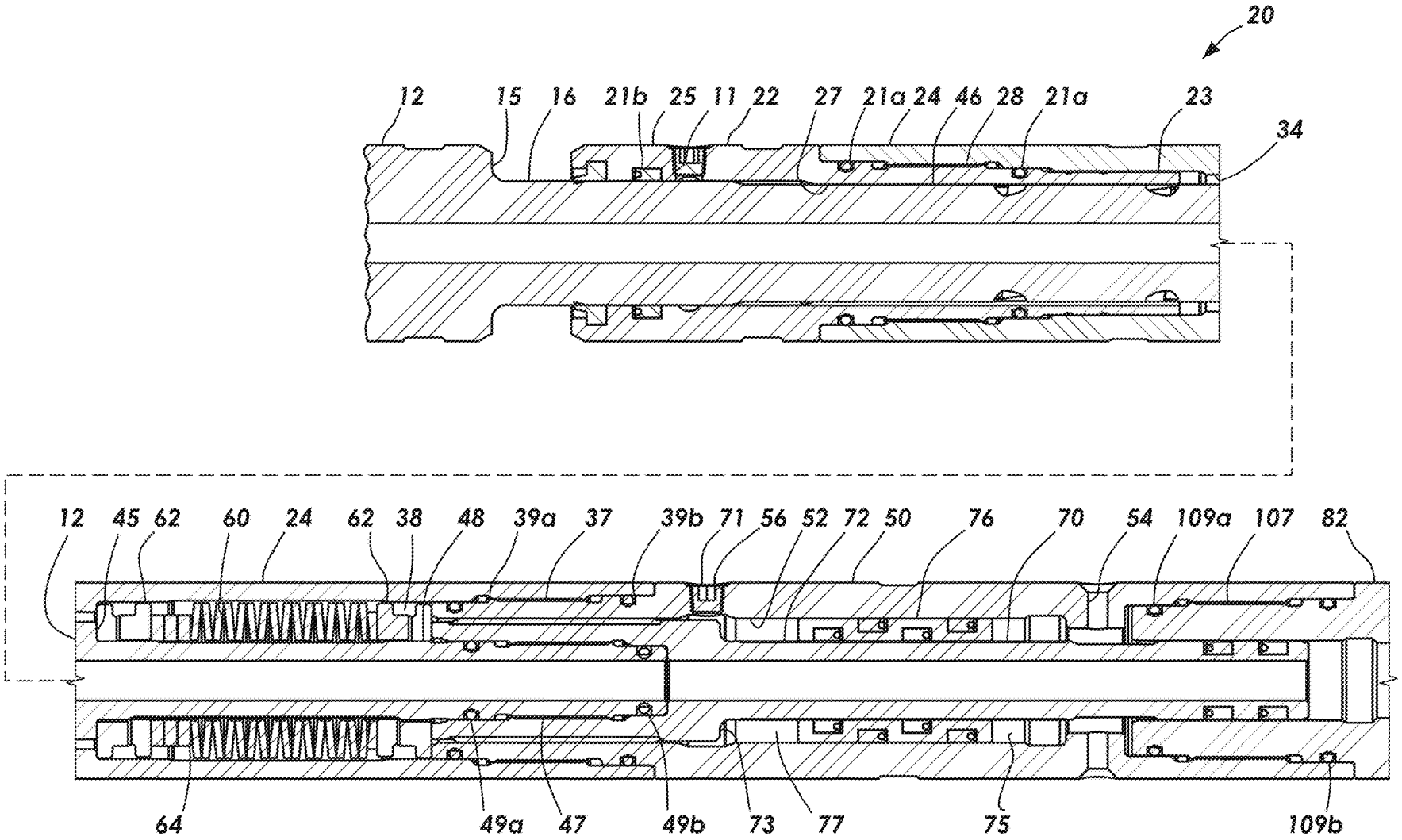
FIGS. 6A and 6B are an enlarged version of FIG. 1.
Figure 6B:
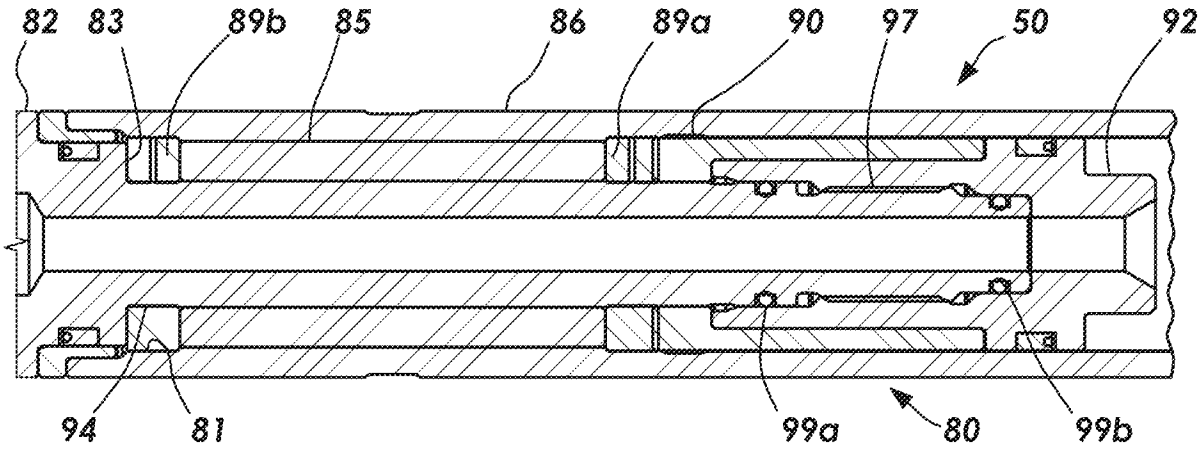

Referring to FIGS. 1, 5, and 6, low frequency portion 20 may include a low frequency mandrel 12, a base 22, and upper and lower housings 24, 50, respectively. Low frequency mandrel 12 may include a connection end 14 at its lower end and an extension 16. Extension 16 includes a bearing section 46 and spring section 48. Bearing section 46 has a smaller outside diameter than that of connection end 14, so that a radial first shoulder 15 is formed therebetween.

Figure 3:
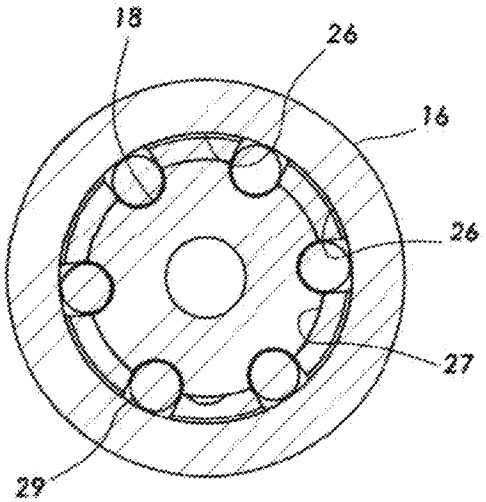
Figure 2:
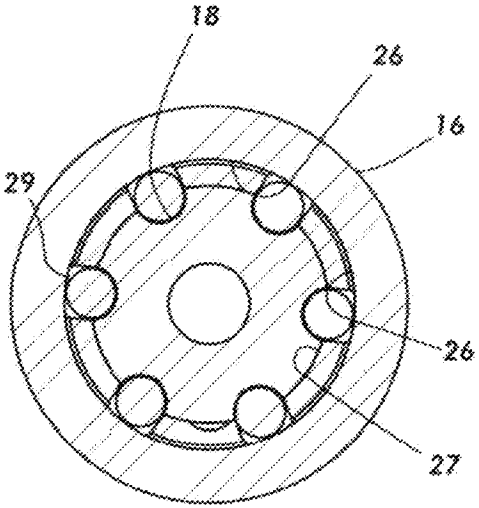

Spring section 48 has a smaller outside diameter than that of bearing section 46, so that a radial second shoulder 45 is formed therebetween. As best illustrated in FIGS. 2, 3 and 5, the outer surface of bearing section 46 includes at least one helical bearing slot 18. In the illustrated embodiment, there are six helical bearing slots 18. In some embodiments, there may be as few as three or as many as twelve helical bearing slots 18.

As best seen in FIG. 6, base 22 may be generally cylindrical, having a tubular base wall 23, a central bore 27 therethrough, and a lower base portion 25. Lower base portion 25 may include an injection port 11. Central bore 27 may be sized to slidably receive low frequency mandrel 12; lower base portion 25 abuts first shoulder 15 when low frequency mandrel 12 is in its highest position relative to base 22. Base wall 23 includes at least one radial hole 26 therethrough. In the illustrated embodiment, there are two rows of six holes 26 each.

Lower housing 24 may likewise be generally tubular, having a central bore 34 that may be configured to receive base wall 23. Lower housing 24 threadedly engages base 22 at threads 28, adjacent to lower base portion 25.

As best seen in FIGS. 2 and 3, each hole 26 in base wall 23 may receive a ball bearing 29. Each ball bearing 29 engages a helical bearing slot 18 on low frequency mandrel 12 and may be retained in its respective hole 26 by the inner surface of lower housing 24. In this manner, ball bearings 29 allow low frequency mandrel 12 to move helically, i.e., axially and rotationally, relative to low frequency portion 20.

Lower housing 24 extends longitudinally beyond base 22. As best seen in FIG. 6, an annulus 38 may be defined between the inner surface of lower housing 24 and the outer surface of spring section 48 of low frequency mandrel 12. Annulus 38 may be bounded at its lower end by second shoulder 45 and sealed at its lower end by seals 21*a* between base 22 and lower housing 24 and by seals 21*b* between base 22 and low frequency mandrel 12. A low frequency damping element 60, which may comprise a stack of Belleville springs, may be received in annulus 38 and surrounds spring section 48 of low frequency mandrel 12. In some embodiments, low frequency damping element 60 may be retained between second shoulder 45 and the lower end of upper housing 50. In some embodiments, low frequency damping element 60 may be compressed when tool 10 is unloaded.

At each end of low frequency damping element 60, a bypass ring 62 may be provided to allow fluid flow past the springs. Each bypass ring includes a pair of radial bearing faces and a fluid path therebetween so that each bypass ring can support an axial load while simultaneously allowing an axial flow of fluid from one side of the bypass ring to the other.

A thrust bearing 64 may also be included between second shoulder 45 and the Belleville spring stack. Thrust bearing 64 allows axial force to be transmitted from low frequency mandrel 12 to the low frequency damping element 60, while allowing relative rotation therebetween and without torsionally loading low frequency damping element 60. It will be understood that low frequency damping element 60 may be replaced with any other suitable device for damping longitudinal movement. By linking axial (longitudinal) and rotational movement via holes 26, ball bearings 29, and helical bearing slots 18, low frequency portion 20 can use low frequency damping element 60 to absorb both axial (longitudinal) and rotational low frequency vibrations.

Still referring to FIG. 6, upper housing 50 may be coupled to lower housing 24 at threads 37. Seals 39*a*, 39*b* may be provided at each end of threads 37. Upper housing 50 has a central bore 52 therethrough and includes a port 54 that allows fluid communication between central bore 52 and the outside of the tool. Upper housing also includes an injection port 71 that may be sealed by a plug 56. A seal carrier 70 may be coupled to the upper end of spring section 48 at threads 47. Seals 49*a*, 49*b* may be provided at each end of threads 47. Seal carrier 70 may be slidable within upper housing 50. Seal carrier 70 includes a reduced diameter portion 72 and a radial shoulder 73. An annulus 75 may be defined between the inner surface of upper housing 50 and the outer surface of reduced diameter portion 72. Annulus 75 may be bounded at its lower end by shoulder 73. Annulus 75 may be in fluid communication with annulus 38. An annular sealing element 76 may be positioned in annulus 75 so as to prevent longitudinal fluid flow through annulus 75. Sealing element 76 may be slidable relative to seal carrier 70 and upper housing 50. A sealed chamber 77 may be thus formed between seals 21*a,b* and sealing element 76. During assembly of tool 10, chamber 77 may be filled with a fluid, which may be oil, via injection port 11 or 71. In some embodiments, chamber 77 may be filled via port 11 while air or other liquid may be evacuated via port 71, so as to allow for maximal filling of chamber 77.

Still referring to FIG. 6, the high frequency portion 80 of tool 10 may include a high frequency mandrel 82, high frequency housing 86, an optional coupler 90, and a nut 92. High frequency mandrel 82 may be coupled to upper housing 50 of low frequency portion 20 at threads 107. Seals 109*a*, 109*b* may be provided at each end of threads 107. In this manner, high frequency portion 80 may be releasably coupled to low frequency portion 20. In some embodiments, coupler 90 may be omitted. High frequency mandrel 82 includes a reduced diameter portion 94 and a radial high frequency shoulder 83 may be defined at the lower end of reduced diameter portion 94.

Figure 4:
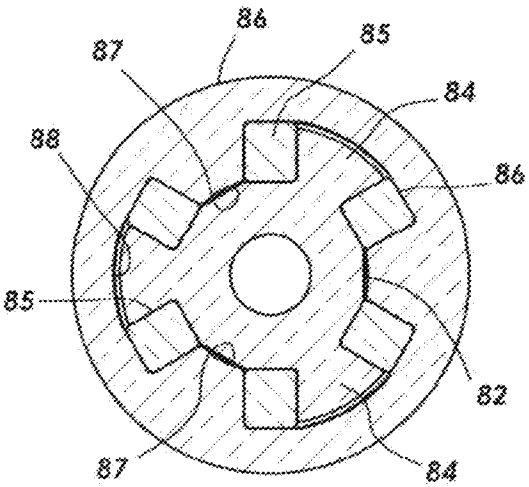
FIGS. 2-4 are cross-sections along the lines 2-2, 3-3, and 4-4, respectively, on FIG. 1.

As best illustrated in FIG. 4, the outer surface of high frequency mandrel 82 includes a plurality of longitudinal keys 84. The inner surface of high frequency housing 86 includes a plurality of longitudinal keyways 88 defined by splines 87. The longitudinal extent of keys 84 and splines 87 may be substantially the same and less than the longitudinal extent of high frequency housing 86. Thus, at least one annular channel 81 may be defined between high frequency shoulder 83 and the lower ends of keys 84 and splines 87. The circumferential extent of each keyway may be greater than the circumferential extent of each key 84 and the resulting longitudinal space(s) may be occupied by a plurality of longitudinal high frequency damping elements 85.

Referring again to FIG. 6, high frequency damping elements 85 may be longitudinally retained in keyways 88 by upper and lower anti-extrusion rings 89*a*, 89*b*. Lower anti-extrusion ring 89*b* occupies channel 81. Upper anti-extrusion ring 89*a* may be optional and, if present, may be disposed between coupler 90 or nut 92 and the upper ends of keys 84 and splines 87. Thus, upper and lower anti-extrusion rings 89*a*, 89*b*, are in turn retained, respectively, by coupler 90 or nut 92 and high frequency shoulder 83. In some embodiments, keys 84 and high frequency damping elements 85 may have the same longitudinal extent, so that keys 84 and high frequency damping elements 85 each bear on anti-extrusion rings 89*a, b*. In some embodiments, anti-extrusion rings 89*a, b* comprise a durable elastomer and are able to absorb some high frequency longitudinal forces. Similarly, in some embodiments, high frequency damping elements 85 are elastomeric and are able to absorb some high frequency torsional forces.

During assembly of the high frequency portion 80 of tool 10, coupler 90 may be advanced against the upper anti-extrusion ring 89*a, b* by nut 92 to the upper end of high frequency mandrel 82. Nut 92 may be coupled to the upper end of high frequency mandrel 82 at threads 97. Seals 99*a*, 99*b* may be provided at each end of threads 97. In this manner, high frequency damping elements 85 are longitudinally constrained and compressed. High frequency mandrel 82 may be retained in high frequency housing 86 by friction between high frequency damping elements 85 and high frequency mandrel 82 and between high frequency damping elements 85 and high frequency housing 86. In some embodiments, high frequency mandrel 82 may be retained in high frequency housing 86 by frictional engagement of at least one of longitudinal high frequency damping element 85 and/or one or both anti-extrusion rings 89*a, b* with high frequency mandrel 82 (on the inside) and high frequency housing 86 (on the outside). In some embodiments, high frequency damping elements 85 may be compressed by a predetermined amount. Compressing high frequency damping elements 85 to a predetermined degree during assembly of tool 10 may allow their response to be tuned or increased, so as to mitigate the risk of backlash during operations.

In operation, a tool 10 may be coupled to a drill string to support a measurement while drilling device (MWD). Low frequency mandrel 12 can move longitudinally and rotationally relative to low frequency portion 20. As low frequency mandrel 12 moves relative to low frequency portion 20, second shoulder 45 bears on low frequency damping element 60 via bypass rings 62 and thrust bearing 64. Low frequency damping element 60 in oil-filled chamber 77 resists that motion and damps the transmission of low frequency vibration between low frequency mandrel 12 and upper housing 50. As low frequency mandrel 12 moves, the volume of chamber 77 varies; movement of well fluid through port 54 allows pressure in chamber 77 to stay at equilibrium with the annulus pressure.

Because of the mass and inertia of the components of low frequency portion 20, low frequency portion 20 may be well suited to absorbing low-frequency vibrational energy. To complement low frequency portion 20, high frequency damping elements 85 may also absorb both rotational and longitudinal forces and anti-extrusion rings 89*a, b* may absorb longitudinal forces. High frequency damping elements 85 are capable of faster deformation than low frequency damping element 60 and can therefore absorb higher frequency vibrations. As forces from the drillstring are transmitted through the various components of tool 10, both high and low frequency longitudinal and rotational vibrations are damped, resulting in less impact and vibration being transmitted to the MWD. As used herein, "low frequency" refers to vibrations at 10 Hz or less and "high frequency" refers to vibrations at more than 10 Hz.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

What is claimed is:

1. An isolator for use with a drill string, comprising:
- a low frequency portion comprising:
  - a low frequency mandrel having first and second ends; and
  - a low frequency housing, the housing defining a chamber in conjunction with the low frequency mandrel, wherein the chamber is fluid-filled and includes a low frequency damping element disposed therein;
  - wherein the low frequency mandrel is slidably received in the chamber; and
- a high frequency portion coupled to the low frequency portion and comprising:
  - a high frequency housing including at least one longitudinal keyway;
  - a high frequency mandrel having first and second ends, a radial high frequency shoulder, and at least one radially extending longitudinal key disposed in the at least one keyway;
  - at least one longitudinal damping element disposed in a keyway alongside the at least one key;
  - at least a first anti-extrusion ring disposed between the high frequency shoulder and the at least one longitudinal damping element; and
  - a nut adjustably coupled to the high frequency mandrel;
  - wherein, as-assembled, the at least one longitudinal damping element is longitudinally compressed between the high frequency shoulder and the nut.

2. The isolator according to claim 1, further including a second anti-extrusion ring disposed between the at least one longitudinal damping element and the nut.

3. The isolator according to claim 2 wherein the first and second anti-extrusion rings are longitudinally compressed between the at least one longitudinal damping element and the nut.

4. The isolator according to claim 1 wherein the high frequency portion further includes a coupler between the nut and the at least one longitudinal damping element.

5. The isolator according to claim 1 wherein the high frequency mandrel is retained in the high frequency housing by frictional engagement of at least one of the longitudinal damping element or the anti-extrusion ring with the high frequency mandrel and the high frequency housing.

6. The isolator according to claim 1 wherein the low frequency housing includes a lower housing, wherein the low frequency portion further includes a base having a base wall, a central bore therethrough, and a lower base portion, wherein the base wall is disposed in an annulus between the low frequency mandrel and the lower housing, wherein the central bore is sized to slidably receive the low frequency mandrel, and wherein the low frequency mandrel and the lower housing are coupled such that axial and rotational movement of the low frequency mandrel relative to the lower housing are linked.

7. The isolator according to claim 6 wherein the base wall includes at least one hole therethrough, wherein the low frequency mandrel has a first outer surface that includes at least one helical slot therein, wherein a ball bearing is supported in the hole by the lower housing, and wherein the low frequency mandrel and the lower housing are coupled by engagement of the ball bearing with the helical slot.

8. The isolator according to claim 1 wherein the low frequency damping element comprises a Belleville spring stack.

9. An isolator for use with a drill string, comprising:
a low frequency portion comprising:
a low frequency mandrel having first and second ends; and
a low frequency housing-portion comprising a fluid-filled chamber, a lower housing, and a low frequency damping element disposed in the chamber;
wherein the low frequency mandrel is slidably received in the chamber such that axial and rotational movement of the low frequency mandrel relative to the lower housing are linked; and
a high frequency portion coupled to the low frequency portion and comprising:
a high frequency housing including at least one longitudinal keyway;
a high frequency mandrel having first and second ends, a radial high frequency shoulder, and at least one radially extending longitudinal key disposed in the at least one keyway;
at least one longitudinal damping element disposed in the at least one keyway alongside the at least one key;
at least one anti-extrusion ring disposed between the high frequency mandrel and the longitudinal damping element; and
a nut adjustably coupled to the high frequency mandrel;
wherein the first anti-extrusion ring and the at least one longitudinal damping element are longitudinally compressed between the high frequency shoulder and the nut.

10. The isolator according to claim 9 wherein the low frequency housing includes a lower housing, wherein the low frequency portion further includes a base having a base wall, a central bore therethrough, and a lower base portion, wherein the base wall is disposed in an annulus between the low frequency mandrel and the lower housing, wherein the central bore is sized to slidably receive the low frequency mandrel, and wherein the low frequency mandrel and the lower housing are coupled such that axial and rotational movement of the low frequency mandrel relative to the lower housing are linked.

11. The isolator according to claim 10 wherein the base wall includes at least one hole therethrough, wherein the low frequency mandrel has a first outer surface that includes at least one helical slot therein, wherein a ball bearing is supported in the hole by the lower housing, and wherein the low frequency mandrel and the lower housing are coupled by engagement of the ball bearing with the helical slot.

12. The isolator according to claim 9 wherein the high frequency mandrel is retained in the high frequency housing by frictional engagement of at least one of the longitudinal damping element or the anti-extrusion ring with the high frequency mandrel and the high frequency housing.

13. The isolator according to claim 9, further including a second anti-extrusion ring disposed between the at least one longitudinal damping element and the nut.

14. The isolator according to claim 13 wherein the high frequency portion further includes a coupler between the nut and the at least one longitudinal damping element.

15. An isolator for use with a drill string, comprising:
a low frequency portion comprising:
a low frequency mandrel having first and second ends; and
a low frequency housing, the housing defining a chamber in conjunction with the low frequency mandrel, wherein the chamber is fluid- filled and includes a low frequency damping element disposed therein;
wherein the low frequency mandrel is slidably received in the chamber; and
a high frequency portion coupled to the low frequency portion and comprising:
a high frequency housing including at least one longitudinal keyway;
a high frequency mandrel having first and second ends, a radial high frequency shoulder, and at least one radially extending longitudinal key disposed in the at least one keyway;
at least one longitudinal damping element disposed in a keyway alongside the at least one key; and
a nut adjustably coupled to the high frequency mandrel;
wherein, as-assembled, the at least one longitudinal damping element is longitudinally compressed between the high frequency shoulder and the nut.

16. The isolator according to claim 15 wherein the high frequency mandrel is retained in the high frequency housing by frictional engagement of at least one of the longitudinal damping element or an anti-extrusion ring with the high frequency mandrel and the high frequency housing.

17. The isolator according to claim 15 wherein the low frequency housing includes a lower housing, wherein the low frequency portion further includes a base having a base wall, a central bore therethrough, and a lower base portion, wherein the base wall is disposed in an annulus between the low frequency mandrel and the lower housing, wherein the central bore is sized to slidably receive the low frequency mandrel, and wherein the low frequency mandrel and the lower housing are coupled such that axial and rotational movement of the low frequency mandrel relative to the lower housing are linked.

18. The isolator according to claim 17 wherein the base wall includes at least one hole therethrough, wherein the low frequency mandrel has a first outer surface that includes at least one helical slot therein, wherein a ball bearing is supported in the hole by the lower housing, and wherein the low frequency mandrel and the lower housing are coupled by engagement of the ball bearing with the helical slot.

* * * * *